United States Patent [19]

Kokubu

[11] Patent Number: 4,983,794

[45] Date of Patent: Jan. 8, 1991

[54] SNAP ACTION SWITCHING DEVICE

[75] Inventor: Sadao Kokubu, Niwa, Japan

[73] Assignee: Kabushiki Kaisha Tokai-Rika-Denki-Seisakusho, Aichi, Japan

[21] Appl. No.: 384,989

[22] Filed: Jul. 25, 1989

[30] Foreign Application Priority Data

Jul. 26, 1988 [JP] Japan ..... 63-187714
Aug. 5, 1988 [JP] Japan ..... 63-104276[U]

[51] Int. Cl.[5] ..... H01H 5/18
[52] U.S. Cl. ..... 200/461
[58] Field of Search ..... 200/445, 459, 461, 467, 200/407, 406, , 460

[56] References Cited

U.S. PATENT DOCUMENTS 2,405,142 8/1946 Holt ..... 200/407
2,813,946 11/1957 Cox ..... 200/445
3,189,703 6/1965 Chapin et al. ..... 200/461

*Primary Examiner*—Renee S. Luebke
*Attorney, Agent, or Firm*—Oliff & Berridge

[57] ABSTRACT

A switching device of the type in which a moving contact provided at the free end of a movable component formed of a plate spring is brought into contact with and separated from fixed contacts by depressing the movable component by means of an operating member. The movable component is equipped with first and second movable parts which are arranged face to face and which are connected to each other at their respective free ends. A first support portion supporting the first movable part which is depressed by the operating member, is positioned farther from the free end than a second support portion supporting the second movable part. The first movable part is equipped with a curved section which allows it to remain free of the second support portion when it is depressed by the operating member. Thus, when the operating member is manipulated, the first movable part can remain free of the second support portion by virtue of its curved portion, so that the first movable member need not be equipped with a through-hole for passing the second support portion.

16 Claims, 16 Drawing Sheets

SNAP ACTION SWITCHING DEVICE

BACKGROUND OF THE INVENTION

1. Field of the Invention

This invention relates to a switching device of a type in which a moving contact is opened and closed with respect to a fixed contact by virtue of a snapping action of a movable member which is made of a plate spring.

2. Description of the Related Art

FIGS. 22 to 24 show, by way of example, a conventional microswitch which is used as a switching device for a window regulator in an automobile.

A movable member 1, made of a plate spring, includes a spring portion 2 which can be bent downwards, a substantially rectangular hole 3 formed around this spring portion 2, and arm portions 14. Formed in a free end portion of this movable member 1 is a moving contact 4. In a base end portion, the movable member 1 has a notched supporting point 5. A notched supporting point 6 is formed at a tip end of the spring portion 2. Formed upright in a case 7 is a terminal plate 10 having first and second support portions 8 and 9 which are spaced a predetermined distance apart. The case 7 further includes fixed contacts 11 and 12 facing each other in a vertical direction. The movable member 1 is arranged in the case 7, with the supporting point 5 in the base end portion thereof and the supporting point 6 at the tip of the spring portion 2 thereof being engaged with and supported by the first and second support portions 8 and 9, respectively.

In the state shown in FIG. 23, the free end portion of the movable member 1 is biased obliquely upwards by a displacing force due to a resilient force of the spring portion 2, and the upward component of the displacing force keeps the moving contact 4 in contact with the fixed contact 11 which is on a usually closed side of the case 7. When, in the state shown in FIG. 23, the base end portion of the movable member 1 is pressed downwards by an operating member 13, and the arm portions 14, 14 of the movable member 1 are brought to a position below the supporting point 6 of the spring portion 2, as shown in FIG. 24, the free end portion of the movable member 1 is biased obliquely downwards by a displacing force due to the resilient force of the spring portion 2, and the downward component of this displacing force causes the free end portion of the movable member 1 to move rapidly downwards, separating the moving contact 4 from the fixed contact 11 on the usually closed side, and bringing it into contact with the fixed contact 12 on a usually open side of the case 7. When the moving contact 4 is thus brought into contact with the fixed contact 12 on the usually open side, a motor of the window regulator is supplied with electricity, thereby causing a window to be raised or lowered.

In the above-described conventional structure, the moving contact 4 is brought into contact with the fixed contact 12 on the usually open side by virtue of a snapping action of the movable member 1. This snapping action can only be realized when movable member 1 is pressed by the operating member 13 to bring a portion of the movable member 1 adjacent to the second support portion 9 to a position below the supporting point 6 of the spring portion 2. As a result, the second support portion 9 in this state inevitably extends through the movable member 1. Hence the necessity for providing the hole 3 in the movable member 1. The problem with this structure is that the electric current to the motor of the window regulator must flow through the arm portions 14, 14 and the spring portion 2 of the movable member 1. Accordingly, the switch cannot have a large current capacity if the width of the arm sections 14, 14 is not sufficiently large. Consequently the width W of the movable member 1 must be relatively large. Furthermore, the width of the spring portion 2 must also be large if it is desired that the moving contact 4 be pressed against the fixed contacts 11 and 12 with a relatively high contact pressure. The movable member 1 will then be required to have a still larger width, resulting in an excessively large overall size.

SUMMARY OF THE INVENTION

This invention has been contrived with a view to eliminating the above mentioned problem. It is accordingly an object of this invention to provide a switching device which, although adopting a snap-action type mechanism, is compact and possesses a large current capacity, and in which a moving contact can be pressed against a fixed contact with a sufficient contact pressure.

In accordance with this invention, there is provided a switching device, comprising: a first movable member consisting of a plate spring, one end of which is formed as a free end and the other end of which is supported by a first support element; a second movable member consisting of a plate spring, one end of which is formed as a free end facing the free end of the first movable member, the other end of which is supported by a second support element situated nearer to the free ends than the first support element, and a middle section of which is formed as a curved portion that is convex in a direction away from the first movable member; a moving contact provided at the free ends of the first and second movable members; an operating member which is capable of displacing the first movable member by depressing the first movable member at a position near the supported end thereof in the direction of the second support element; fixed contacts which can touch and be separated from the moving contact in response to the displacement of the first movable member; and a curved portion which is provided in the first movable member and which allows the first movable member to remain free of the second support element when the first movable member is depressed by the operating member.

The first and second movable members may be formed as an integral plate member in which these movable members are connected to each other at their respective free ends. The integral plate member may be bent at its free end, thereby making the first and second movable members face each other.

With the above described structure, the first movable member remains free of the second support element when the supported base end portion of the first movable member is depressed by the operating member. In spite of this fact, the snapping action of the first movable member can be realized since a straight line connecting the free end and the base end portions of the first movable member at the ends of the curved section thereof comes to a position below the base end fulcrum section of the second movable member. Accordingly, there is no need for providing in the first movable member a through hole for allowing the passage of the second support element. As a result, the switching device can be compact yet possess a greater current capacity than in the prior art, and, at the same time, the moving contact can be pressed against the respective fixed contacts with a sufficient contact pressure.

Moreover, by adopting a structure in which the first and second movable members are connected to each other at their respective free ends, these movable members can be prepared more easily and with fewer parts than in the prior art. At the same time, the conductivity in the free end portions of the first and second movable members can be improved, mitigating the generation of heat due to the electric current concentration.

BRIEF DESCRIPTION OF THE DRAWINGS

FIGS. 1 to 21 are drawings pertaining to an embodiment of this invention, of which:

FIGS. 1 and 2 are longitudinal sectional front views showing the embodiment before and after operation;

FIG. 3 is a development of a moving contact plate used in the embodiment;

FIG. 4 is a top view of a sub-switching device of this invention;

FIG. 5 is a bottom view of the same;

FIG. 6 is a front view of the same;

FIG. 7 is a side view of the same;

FIG. 8 is a bottom view of a case of the sub-switching device;

FIG. 9 is a top view of the base of the same;

FIGS. 10 and 11 are a development and a top view after processing, of a conductor plate of the case;

FIGS. 12 and 13 are a development and a top view after processing, of the base of the same;

FIGS. 14 to 18 show the main switching device of this invention in a manner similar to FIGS. 4 to 8;

FIGS. 19 and 20 show the main switching device in a manner similar to FIGS. 10 and 11; and FIG. 21 is an electrical diagram of the embodiment.

FIGS. 22 to 24 are drawings showing a conventional switching device, of which:

FIG. 22 is a top view of a movable member of this conventional switching device; and FIGS. 23 and 24 show an essential part of the conventional switching device in a manner similar to FIGS. 1 and 2.

DETAILED DESCRIPTION OF THE PREFERRED EMBODIMENTS

An embodiment of this invention will now be described with reference to FIGS. 1 to 21.

The embodiment is shown as applied to a switching device of a window regulator in an automobile. This embodiment consists of a sub-switching device 21 which is operated on a passenger's seat side and a main switching device 22 which is operated on the driver's seat side.

Figure 8:
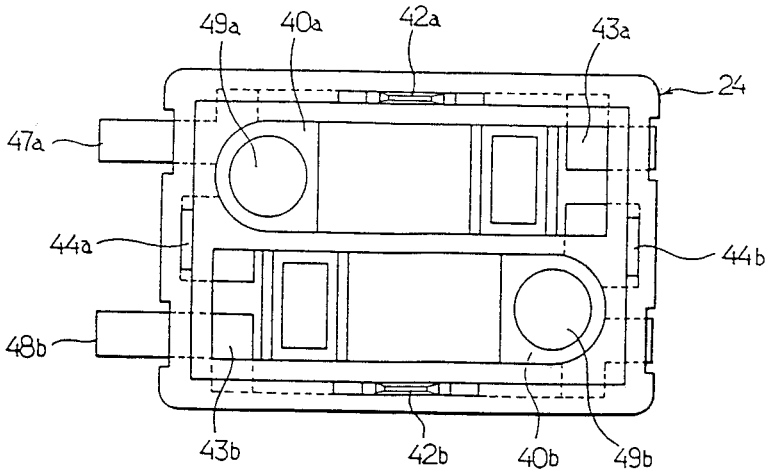
Figure 9:
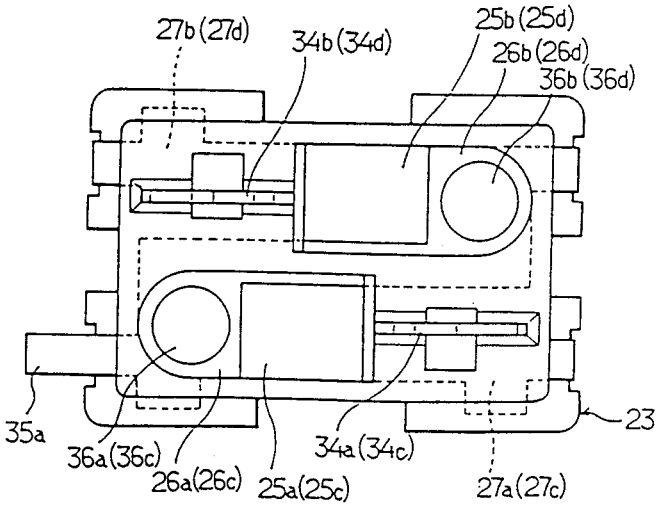
Figure 10:
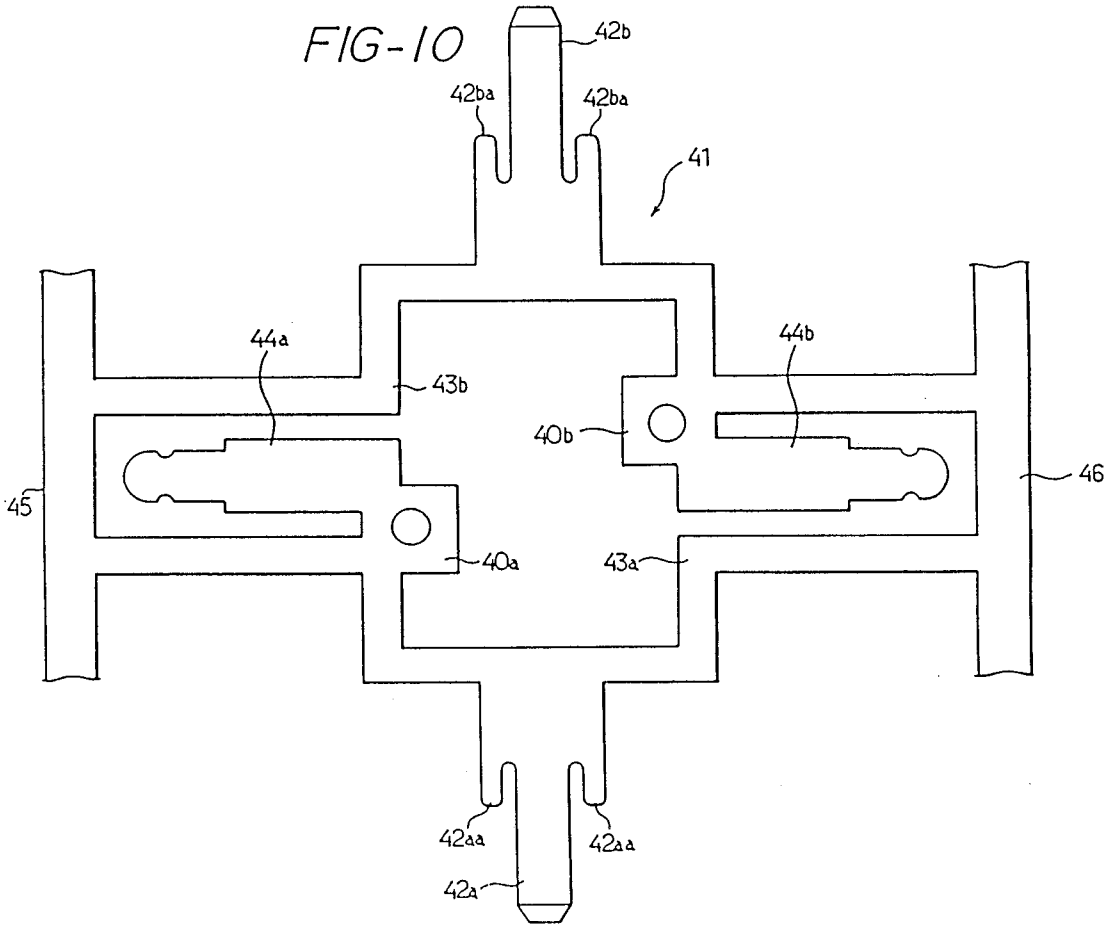
Figure 11:
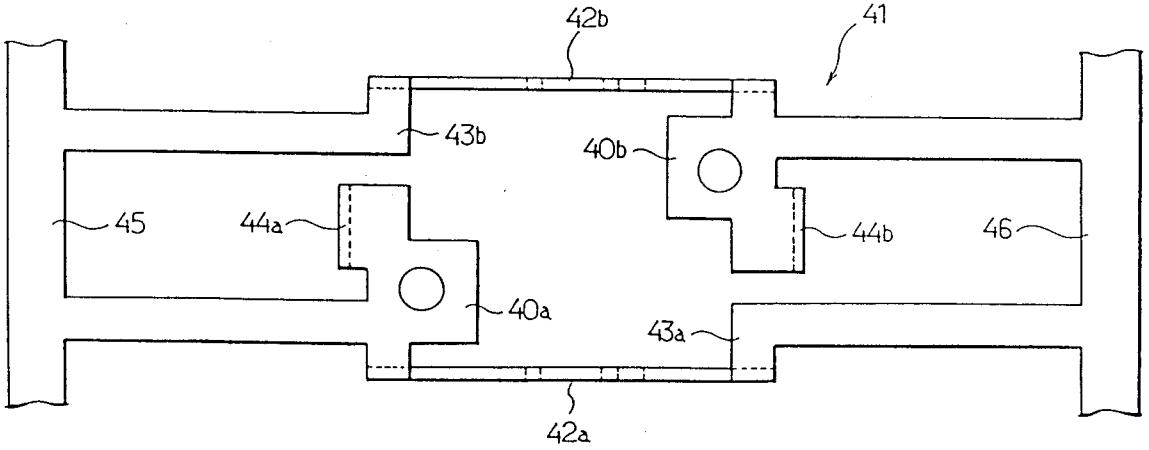
Figure 12:
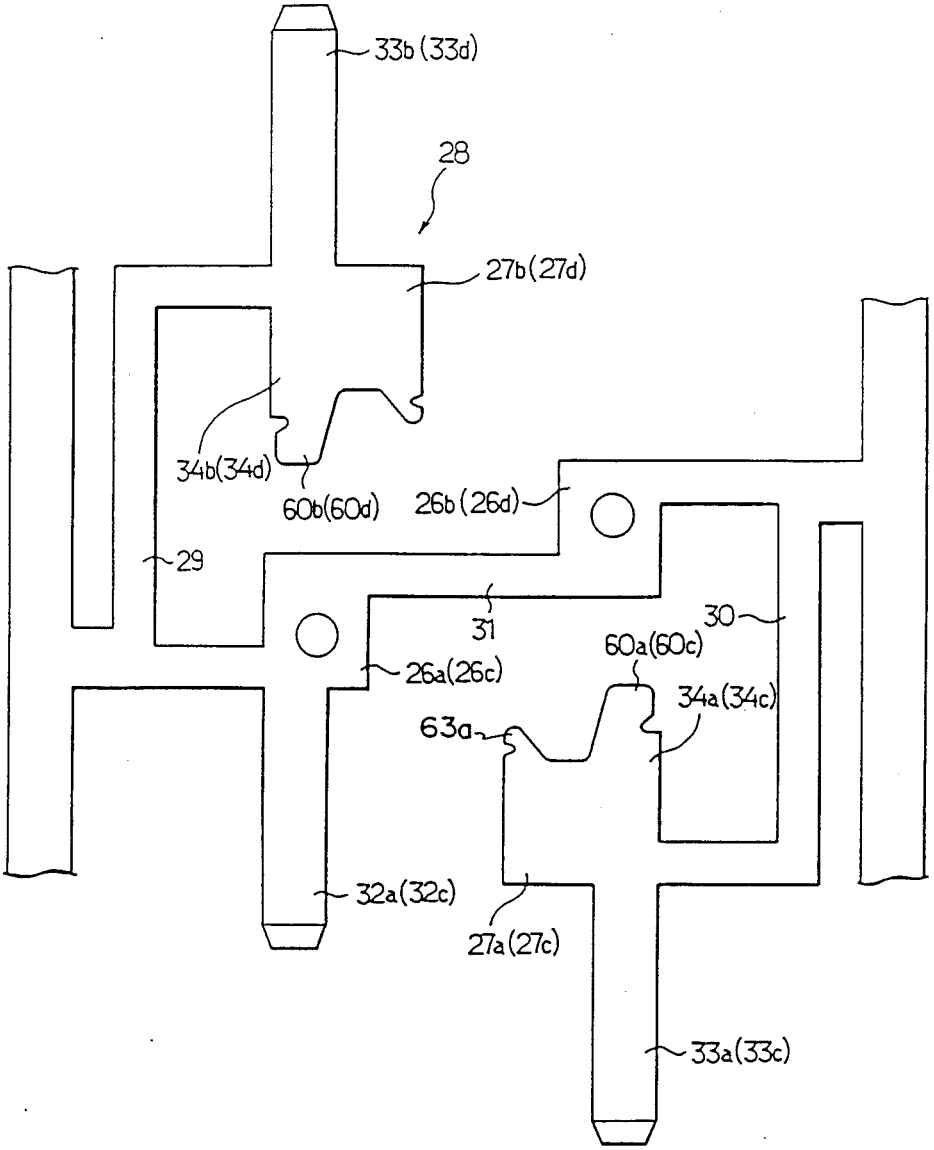
Figure 13:
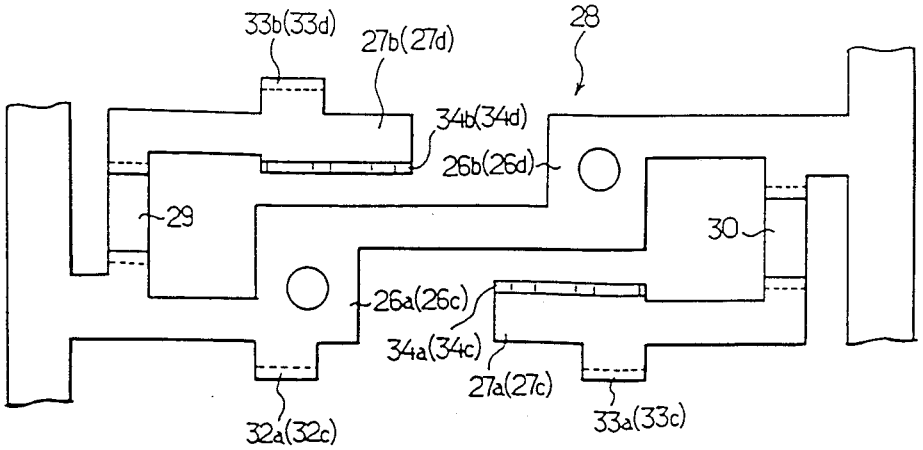
Figure 14:
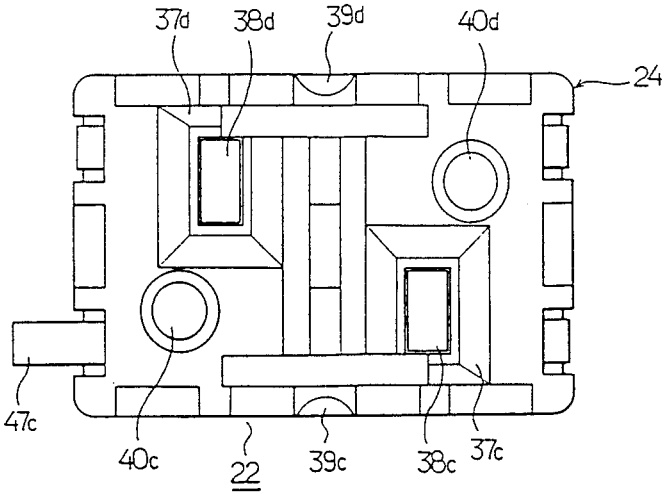
Figure 15:
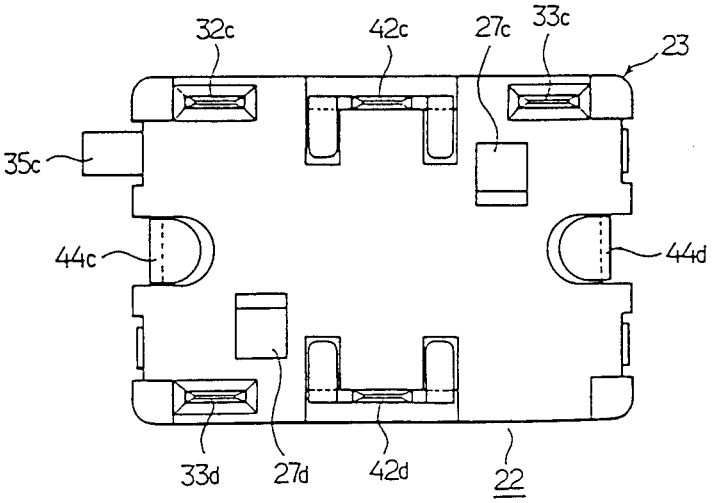
Figure 16:
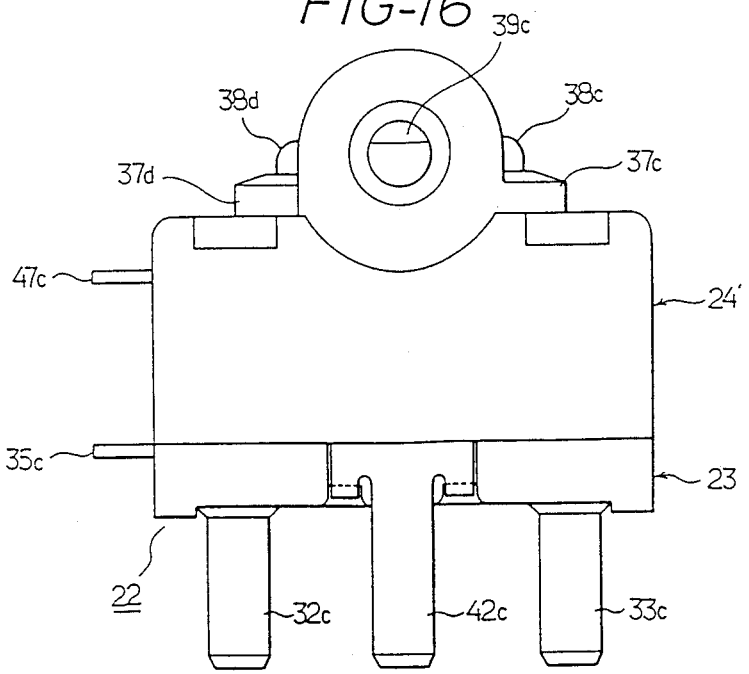
Figure 17:
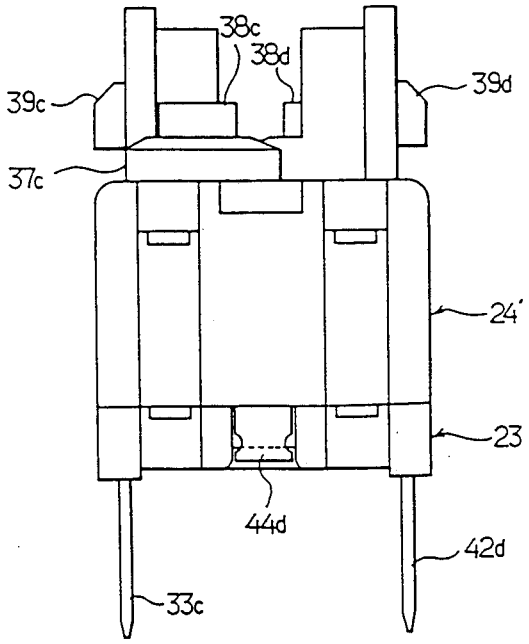

First, the overall structure of the sub-switching device 21 will be described with reference to FIGS. 1 to 13. The sub-switching device 21 includes a substantially rectangular base 23 of an insulating material. To the upper end section of the base 23 is attached a case 24 also made of an insulating material and formed as a rectangular vessel having an open bottom section. Formed on the upper surface of the base 23 are elongated recesses 25*a* and 25*b* which are arranged symmetrically. Further, fixed contact conductors 26*a*, 26*b* and moving contact conductors 27*a*, 27*b* are integrally arranged in the manner described below (see FIG. 9). These conductors are formed as part of a conductor plate 28 formed by punching using a press. As shown in FIG. 12, the conductors 26*a* and 27*b*, and the conductors 26*b* and 27*a* are connected to each other through connecting conductors 29 and 30, respectively. Likewise, the conductors 26*a* and 26*b* are connected to each other through a connecting conductor 31. This conductor plate 28 includes main terminals 32*a*, 33*a* and 33*b*, which extend outwardly from the conductors 26*a*, 27*a* and 27*b*, respectively, and which constitute fixed contact terminals on the usually open side. These main terminals 32*a*, 33*a* and 33*b* are bent downwards. The conductor plate 28 also includes support element conductors 34*a* and 34*b* which extend inwardly from the conductors 27*a* and 27*b*, respectively. These support element conductors 34*a* and 34*b* are bent upwards. The connecting conductors 29 and 30 are bent into a U-shape. Thus, the conductor plate 28 is bent into a predetermined configuration as shown in FIG. 13 by use of a press. Afterwards, it is integrally formed into the base 23 through a so called insert forming method using an insulating material. After this insert forming, the connecting conductors 29 and 30 are cut by use of a press, leaving only the auxiliary terminal 35*a* of the fixed contact conductor 26*a* to protrude from a side of the base 23, as shown in FIG. 9. Fixed to the fixed contact conductors 26*a* and 26*b* exposed in the recesses 25*a* and 25*b* are cylindrical fixed contacts 36*a* and 36*b*, respectively. The case 24 includes upwardly protruding blocks 37*a* and 37*b* provided with rectangular holes which are situated at positions facing the respective support section conductors 34*a* and 34*b* of the moving contact conductors 27*a* and 27*b* (see FIGS. 1 and 4). Operating members 38*a* and 38*b* are inserted into the rectangular holes of blocks 37*a* and 37*b* in such a manner as to be movable in the vertical direction. The top sections of these operating members 38*a* and 38*b* protrude beyond the upper surface of the case 24. Provided in the middle sections of the upper side edges are knob support elements 39*a* and 39*b* for rotatably supporting knobs (not shown). By rotating these knobs, the operating members 38*a* and 38*b* can be pressed and lowered. Referring to FIG. 8, provided at positions respectively facing the fixed contact conductors 26*a* and 26*b* are fixed contact conductors 40*a* and 40*b* which are integrally formed with the case 24 by the previously mentioned insert forming method. Thus, a conductor plate 41 shown in FIG. 10 is formed into the case 24. This conductor plate 41 includes main terminals 42*a* and 42*b* which constitute fixed contact terminals on the usually closed side, each of which has claw sections 42*aa* and 42*ba* on both sides thereof. The conductor plate 41 further includes auxiliary conductors 43*a*, 43*b*, and engagement claw sections 44*a*, 44*b*. The conductors 40*a*, 43*b* and the conductors 40*b*, 43*a* are connected to each other through connecting conductors 45 and 46. The main terminals 42*a* and 42*b* as well as the engagement claw sections 44*a* and 44*b* are bent downwards by use of a press, resulting in predetermined configuration as shown in FIG. 11. Afterwards, the conductor plate 41 is formed into the case 24 by insert forming using an insulating material. After insert forming, the connecting conductors 45 and 46 are cut by use of a press. As a result, the respective auxiliary terminals 47*a* and 48*b* of the fixed contact conductor 40*a* and the auxiliary conductor 43*b* protrude from a side of the case 24, as shown in FIG. 8, which is a bottom view of the case. Fixed to the central sections of the fixed contact conductors 40*a* and 40*b* are cylindrical fixed contacts 49*a* and 49*b* on the usually closed side. In the state in which this case 24 is attached to an upper end portion of the base 23, the main terminals 42a and 42b abut against the recesses formed in the base 23, and the claw portions 42aa and 42ba formed on both sides of the respective main terminals are bent along the bottom surface of the base 23. Likewise, the engagement claw portions 44a and 44b abut against the recesses formed in the base 23, and the respective lower end portions of the engagement claw portions are bent along the bottom surface of the base 23. Thus, the case 24 and the base 23 are connected to each other.

Figure 2:
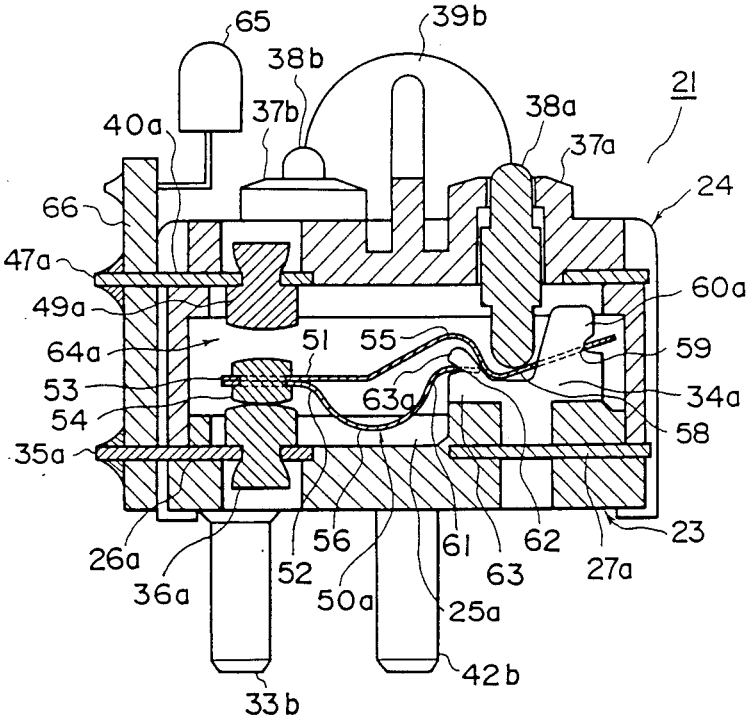
Figure 3:
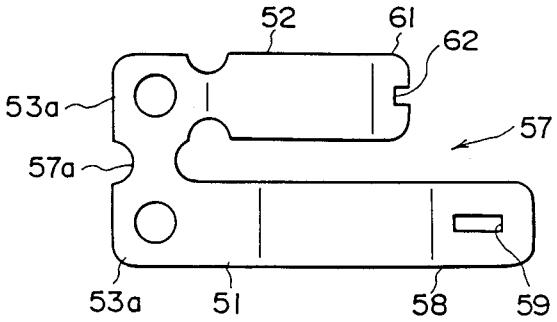
Figure 4:
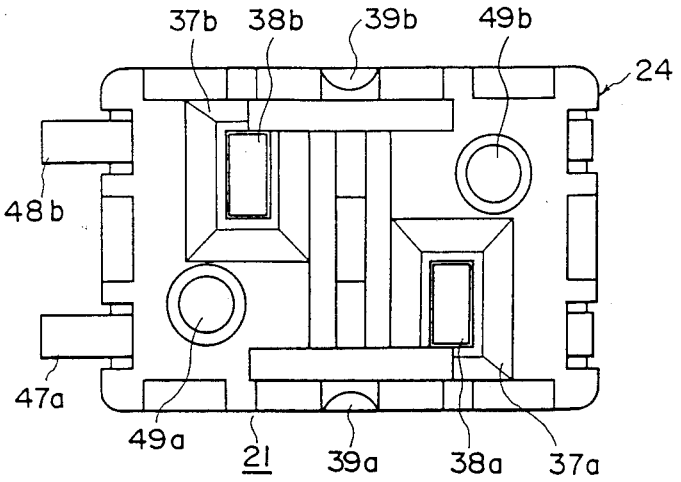
Figure 5:
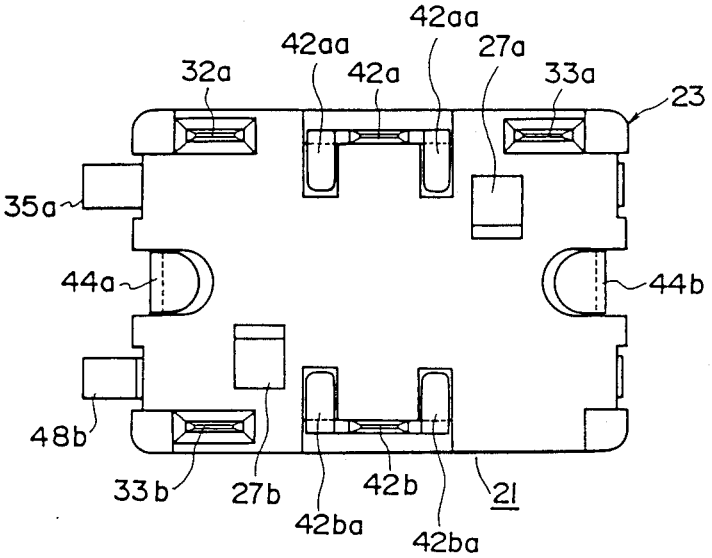
Figure 6:
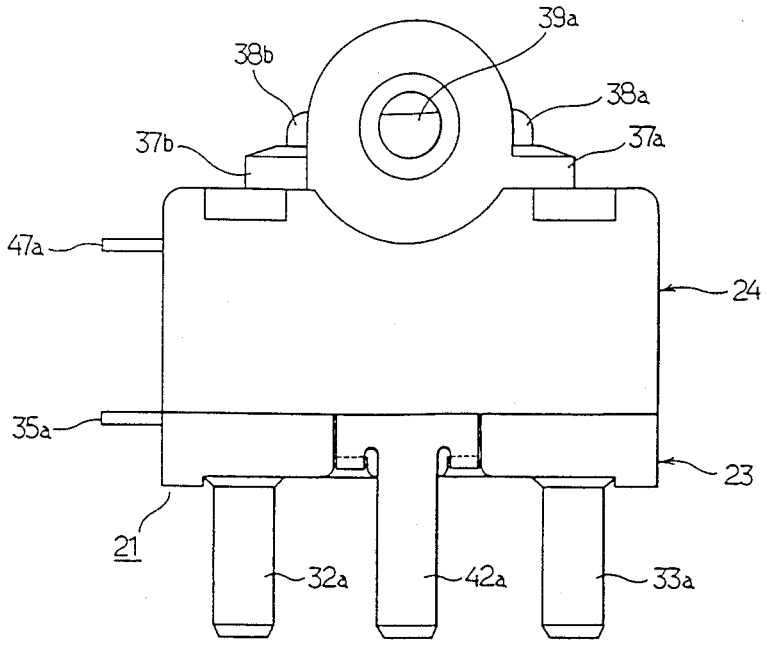
Figure 7:
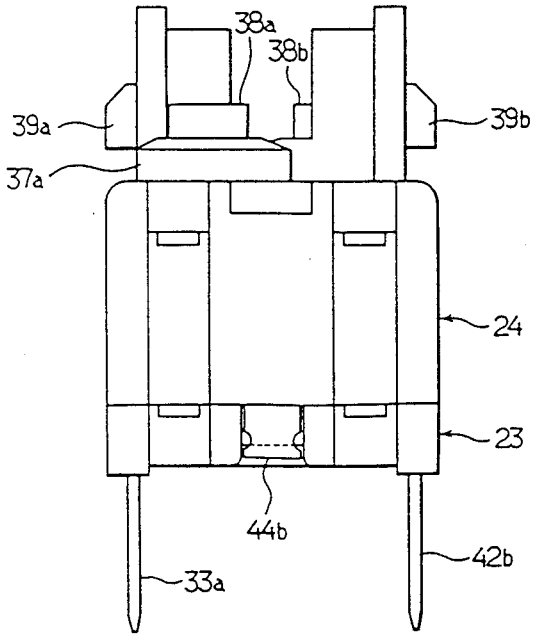

A moving contact plate 50a consists of a first and a second movable member 51 and 52 which are connected to each other at a free end portion 53 (53a, 53a) thereof. A cylindrical moving contact 54 is fixed to this free end portion 53. The first or upper movable member 51 has an upwardly convex curved portion 55 formed in a middle portion thereof, and the second or lower movable member 52 has a downwardly convex curved portion 56 formed in a middle portion thereof. In the example shown, the moving contact plate 50a is formed, as shown in FIG. 3, of a single conductor plate 57 which is obtained through punching by use of a press. Thus, this conductor plate 57 includes the first and second movable members 51 and 52 arranged side by side and connected to each other at their free ends 53a, 53a through a connecting portion 57a. After forming the curved sections 55 and 56, this conductor plate 57 is folded over at the connecting portion 57a. The base end portion 58 of the first movable member 51 includes a first base end pivot 59 which is formed as a rectangular hole and into which a first support 60a formed on the right side end (as viewed in FIG. 1) of the support conductor 34a is inserted and engaged therewith. The base end portion 61 of the second movable member 52 includes a second base end pivot 62 which is formed as a cutout and which engages with a second support 63a formed on the left side end of the support conductor 34a and situated somewhat lower than the first support 60a. Thus, the moving contact plate 50a is supported and retained by the support conductor 34a. In this state, a displacing force derived from a resilient action of the curved portion 56 of the second movable member 52 is exerted on the free end 53, biasing it upwards to the left (as viewed in FIG. 1). The upward component of this displacing force causes the moving contact 54 to be pressed against the fixed contact 49a on the usually closed side with a certain contact pressure. At the same time, the operating member 38a abuts against the base end portion 58 of the first movable member 51. Thus, the moving contact plate 50a having the moving contact 54, and the fixed contacts 36a and 49a on the usually open and usually closed sides, form a switching section 64a (FIG. 2). At the same time, a moving contact plate 50b is prepared in the same manner as the moving contact plate 50a, and forms a switching section 64b (see FIG. 21). The components of this switching section 64b which are identical to those of the switching section 64a will be referred to with the same reference numerals, but with the suffix (b) instead of (a). Thus, the moving contact plate 50b is supported and retained by a support conductor 34b of a moving contact conductor 27b, a moving contact 54b thereof being pressed against a fixed contact 49b on the usually closed side with a certain contact pressure. Thus, the moving contact plate 50b having the moving contact 54b forms the switching section 64b, together with the fixed contacts 36b and 49b, on the usually open and usually closed sides.

Figure 1:
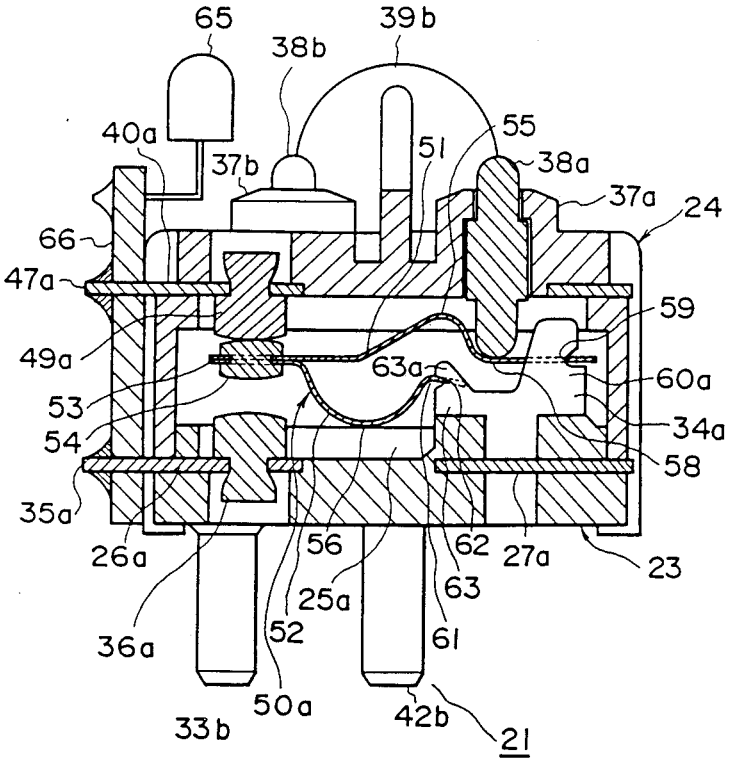

A printed circuit board 66 having a light emitting diode 65 described later is attached to the side of the subswitching device 21 from which the auxiliary terminals 35a, 47a and 48b protrude, as shown in FIG. 1.

Next, the construction of the main switching device 22 will be described with reference to FIGS. 14 to 20. As with the sub-switching device 21, the main switching device 22 comprises two switching sections 64c and 64d. Those components which are identical to those of the above-described switching sections 64a and 64b will be referred to by the same reference numerals with the suffixes (c) and (d) instead of (a) and (b). The other components which have their counterparts in the sub-switching device 21 will also be referred to by the same reference numerals. In the following, a description will be given focusing on the differences between the main and sub-switching devices 22 and 21.

Figure 18:
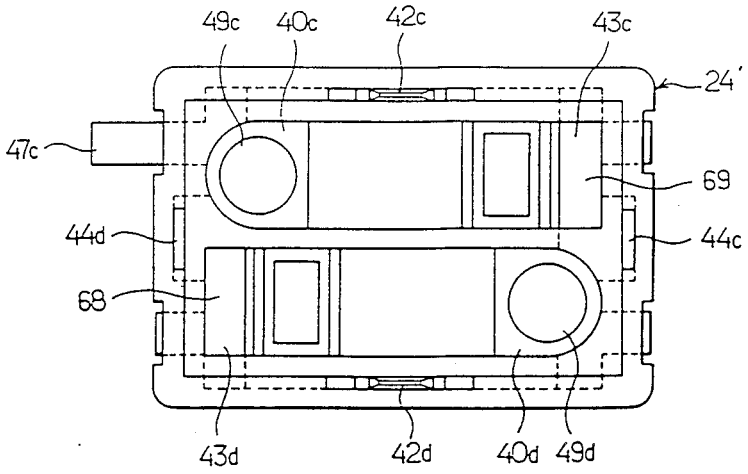
Figure 19:
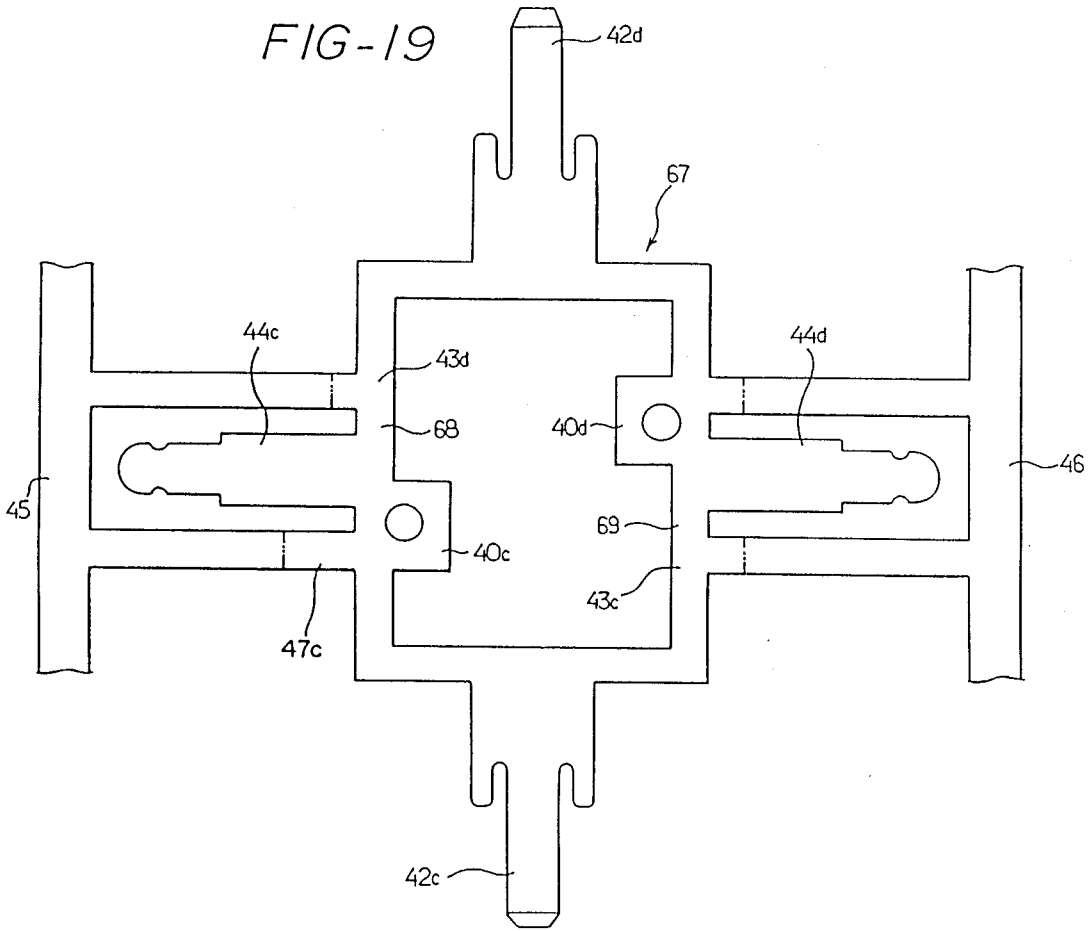
Figure 20:
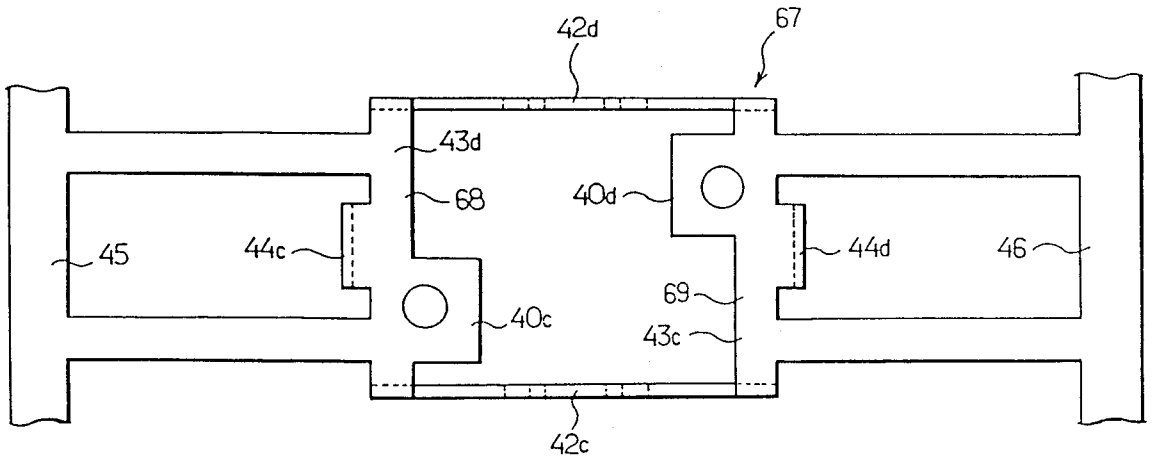

Fixed contact conductors 40c and 40d, which are to be incorporated into a case 24' of the main switching device 22 by insert forming, are formed, as shown in FIG. 19, of a conductor plate 67 which is obtained through punching by use of a press. As in the conductor plate 41 of the sub-switching device 21, the fixed contact conductors 26c and 26d of the main switching device are formed by connecting auxiliary conductor portions 43d and 43c respectively to engagement claw portions 44c and 44d through connecting conductor 68 and 69, respectively. As with the above-described conductor plate 41, this conductor plate 67 is formed into a configuration shown in FIG. 20 by press bending. After insert-forming, the connecting conductors 45 and 46 are cut by use of a press, thus forming the case 24'. As shown in FIG. 18, which is a bottom view of the case 24', only the auxiliary terminal 47c of the fixed contact conductor protrudes from a side of the case 24'. A printed circuit board 71 having a light emitting diode 70 to be described later is attached to a side of the main switching device 22 from which the auxiliary terminals 35c and 47c protrude.

Next, the electrical construction of this embodiment will be described with reference to FIG. 21. Reference numerals 72 and 73 indicate positive and negative D.C. power source terminals which are connected to main terminals 32c and 42d respectively of the main switching device 22. In this main switching device 22, the main terminal 32c is connected to the fixed contacts 36c and 36d on the usually open side as well as the auxiliary terminal 35c. Main terminals 42c and 42d are connected to each other through the above-mentioned connecting conductors 68 and 69. At the same time, they are connected to the fixed contact 49c and 49d on the usually closed side as well as the auxiliary terminal 47d. Main terminals 33c and 33d are connected to the moving contact plates 50c and 50d, respectively. Provided between the auxiliary terminals 35c and 47d is a serial circuit including the above-mentioned light emitting diode 70 and a resistor 74 which are arranged on the printed circuit board 71 mentioned above. The main terminals 33c and 33d of this main switching device 22 are connected to the main terminals 42a and 42b of the sub-switching device 21, respectively, the main terminal 32a of the sub-switching device 21 being connected to the positive D.C. power source terminal 72. In this sub-switching device 21, the main terminal 32a is connected to the fixed-terminal sections 36a and 36b on the usually open side as well as the auxiliary terminal, 35a. The main terminal 42a is connected to the fixed contact 49a on the usually closed side and the auxiliary terminal 47*a*, and the main terminal 42*b* is connected to the fixed contact 49*b* on the usually-closed side and the auxiliary terminal 48*b*. The auxiliary terminal 35*a* is connected to one end of a series circuit including the above-mentioned light emitting diode 65 and a resistor 75 which are arranged on the above-mentioned printed circuit board 66. The other end of this series circuit is connected to the auxiliary terminals 47*a* and 48*b* through diodes 76 and 77, respectively. The reference numeral 78 indicates a D.C. motor for driving the window. Terminals of this motor are connected to the main terminals 33*a* and 33*b* of the sub-switching device 21. When a positive power-source voltage is applied to the main terminal 33*a*, the motor rotates in the normal direction, and, when it is applied to the main terminal 33*b*, the motor rotates in the reverse direction, thereby raising and lowering the window.

The operation of this embodiment will now be described.

First, in the state shown in FIG. 1, which is a sectional view of the sub-switching device 21 on the side of the switching section 64*a*, the free end 53 of the moving contact plate 50*a* is biased upwards to the left (as seen in FIG. 1) by a displacing force due to the resilient force of the curved section 56 of the second movable member 52. The upward component of the displacing force keeps the moving contact 54 in contact with the fixed contact 49*a* on the usually closed side. In this condition, a knob (not shown) which is arranged above this sub-switching device 21 is rotated to press the operating member 38*a* downwards. Then, the base end portion 58 of the first movable member 51 of the moving contact plate 50*a* is displaced downwards as it is deformed to define a curve. Afterwards, the curved section 55 of the first movable member 51 is lowered until a straight line connecting the base end and the free end portions at the ends of the curved section 55 becomes lower than the base end support portion 62 of the second movable member 52, with the curved portion 55 covering the second support portion 63*a*.

Then, the free end portion 53 of the moving contact plate 50*a* is biased downward to the left (as seen in FIG. 2) by a displacing force derived from the resilient force of the curved portion 56 of the second movable member 52. The downward component of the displacement causes the free end portion 53 to move quickly downwards. This snapping action results in the moving contact 54 being separated from the fixed contact 49*a* on the usually closed side and coming into contact with the fixed contact 36*a* on the usually open side, thus attaining the state shown in FIG. 2.

When the pressing force applied to the operating member 38*a* through the above-mentioned knob is removed, the first movable member 51 of the moving contact plate 50*a* is restored to its original state by virtue of its resilient force, and a straight line connecting the base end and free end portions at the ends of the curved portion 55 comes to a position higher than the base end support portion 62 of the second movable member 52. Then, the free end portion 53 of the second movable member 52 is biased upwards to the left (as seen in the drawing) by a displacing force derived from the resilient force of the curved portion 56 of the second movable member 52. The upward component of this displacing force causes the free end 53 to move quickly upwards. That is, the moving contact 54 is separated from the fixed contact 36*a* on the usually open side and comes into contact with the fixed contact 49*a* on the usually closed side, thus returning to the state shown in FIG. 1. The above-described series of movement is also performed by the other switching section 64*b* of the sub-switching device 21 as well as the switching sections 64*c* and 64*d* of the main switching device 22.

Figure 21:
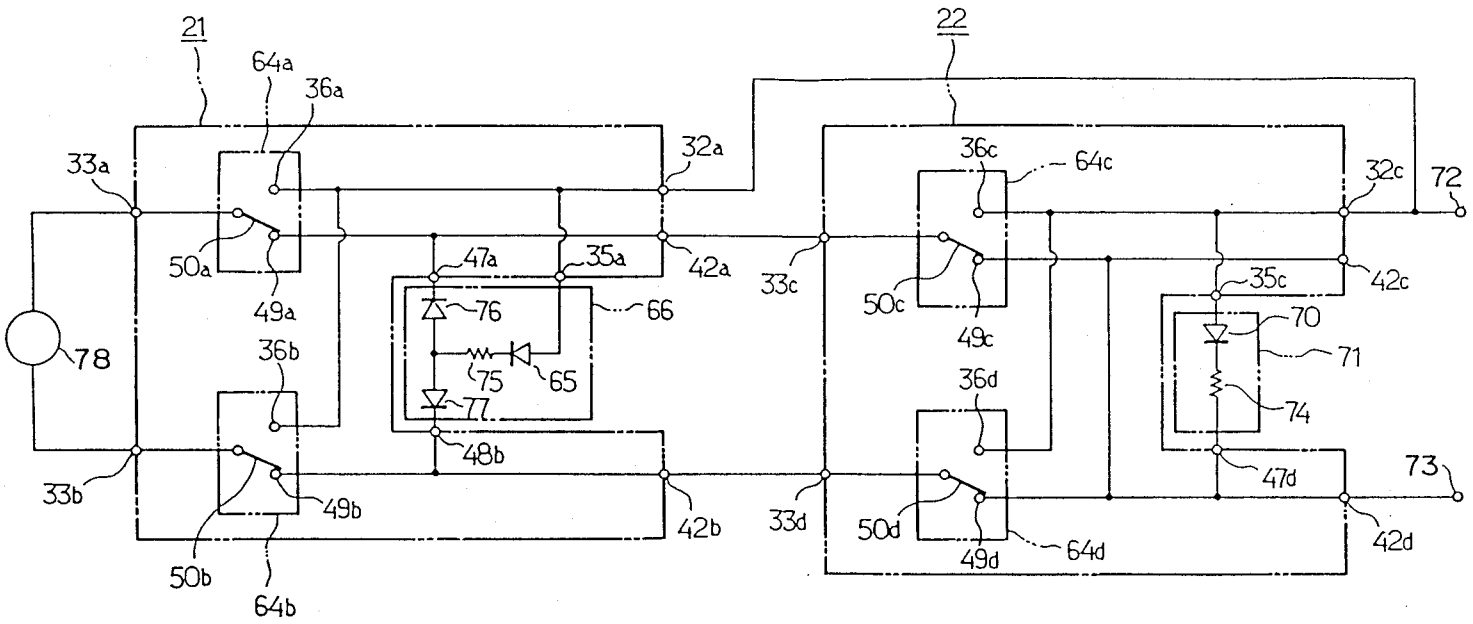
Figure 22:
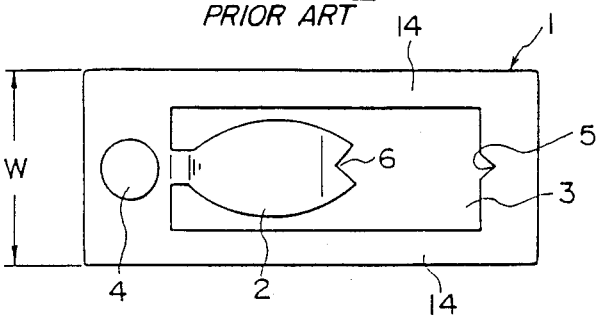
FIG-22 PRIOR ART
Figure 23:
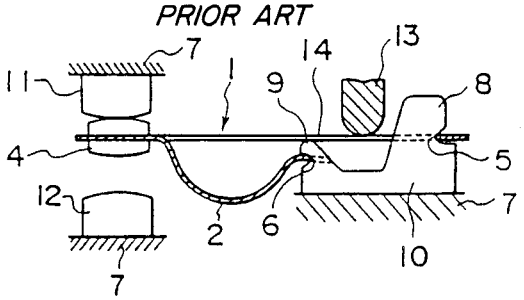
FIG-23 PRIOR ART
Figure 24:
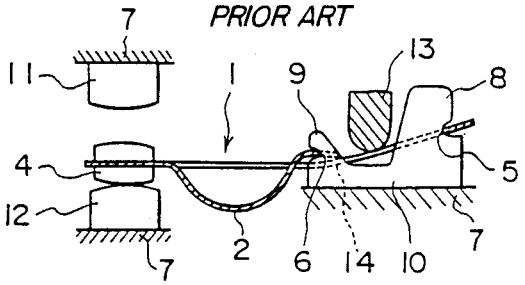
FIG-24 PRIOR ART

When the switching sections 64*a* to 64*d* have reset, the electrical condition shown in FIG. 21 is attained. In this condition, the light emitting diode 70 of the main switching device 22 is on, electricity being supplied by way of the positive D.C. power source terminal 72, the main terminal 32*c*, the auxiliary terminal 35*c*, the light emitting diode 70, the resistor 74, the auxiliary terminal 47*d*, the main terminal 42*d* and the negative D.C. power source terminal 73. Also the light emitting diode 65 of the sub-switching device 21 is on, electricity being supplied by way of the positive D.C. power source terminal 72, the main terminal 32*a*of the sub-switching device 21, the auxiliary terminal 35*a*, the light emitting diode 65, the resistor 75, the diode 77, the auxiliary terminal 48*b*, the main terminal 42*b*, the main terminal 33*d* of the main switching device 2, the moving contact plate 50*d*, the fixed contact 49*d* on the usually closed side, the main terminal 42*d* and the negative D.C. power source terminal 73. At this time, the cathode of this light emitting diode 65 is connected to the negative D.C. power source terminal 73 through the resistor 75, the diode 76, the auxiliary terminal 47*a* of the sub-switching device 21, the main terminal 42*a*, the main terminal 33*c* of the main switching device 22, the moving contact plate 50*c*, the fixed contact 49*c* on the usually closed side, and the main terminal 42*d*.

Suppose, in the switching section 64*a* of the sub-switching switching device 21, the moving contact plate 50*a* comes into contact with the fixed contact 36*a* on the usually open side. Then, the D.C. motor 78 rotates in the normal direction, electricity being supplied through the positive D.C. power source terminal 72, the main terminal 32*a* of the sub-switching device 21, the fixed contact 36*a* on the usually open side, the moving contact plate 50*a*, the main terminal 33*a*, the D.C. motor 78, the main terminal 33*b* of the sub-switching device 21, the moving contact plate 50*b*, the fixed contact 49*b* on the usually closed side, the main terminal 42*b*, the main terminal 33*d* of the main switching device 22, the moving contact plate 50*d*, the fixed contact 49*d* on the usually closed side, the main terminal 42*d*, and the negative D.C. power source terminal 73. Accordingly, by operating this switching section 64*a*, the window (not shown) can be raised, for example, even when the switching section 64*a* has thus been switched, the light emitting diodes 65 and 70 continues to be on as in the state described above.

Next, when the knob of the sub-switching device 21 is operated in the direction reverse to that described above, and the moving contact plate 50*b* of the switching section 64*b* comes into contact with the fixed contact 36*b* on the usually open side, then the D.C. motor 78 is rotated in the reverse direction, electricity being supplied through the positive D.C power source terminal 72, the main terminal 32*a* of the sub-switching device 21, the fixed contact 36*b* on the usually open side, the moving contact 50*b*, the main terminal 33*b*, the D.C motor 78, the terminal 33*a* of the sub-switching device 21, the moving contact plate 50*a*, the fixed contact 49*a* on the usually closed side, the main terminal 42*a*, the main terminal 33*c* of the main switching device 22, the moving contact plate 50*c*, the fixed contact 49*c* on the usually closed side, the main terminal 42*d*, and the negative D.C. power source terminal 73. Accordingly, by operating this switching section 64b, the window (not shown) can be lowered, for example. Even when the switching section 64b is thus changed over, the light emitting diodes 65 and 70 continue to be on as in the above-mentioned case.

Next, the case where the main switching device 22 is operated will be described.

First, the knob (not shown) which is arranged above this main switching device 22 is rotated, causing the moving contact plate 50c of the switching section 64c to come into contact with the fixed contact 36c on the usually open side. Then, the D.C. motor 78 rotates in the normal direction to raise the window, electricity being supplied through the positive power source terminal 72, the main terminal 32c of the main switching device 22, the fixed contact 36c on the usually open side, the moving contact plate 50c, the main terminal 33c, the main terminal 43a of the sub-switching device 21, the fixed contact 49a on the usually closed side, the moving contact plate 50a, the main terminal 33a, the D.C. motor 78, the main terminal 33b of the sub-switching device 21, the moving contact plate 50b, the fixed contact 49b on the usually closed side, the main terminal 42b, the main terminal 33d of the main switching device 22, the moving contact plate 50d, the fixed contact 49d on the usually closed side, the main terminal 42d, and the negative D.C. power source terminal 73. Even when the switching section 64c is thus changed over, the light emitting diode 65 continues to be on since its cathode is connected to the negative D.C. power source terminal 73 through the resistor 75, the diode 77, the auxiliary terminal 48b of the sub-switching device 21, the main terminal 42b, the main terminal 33d of the main switching device 22, the moving contact plate 50d, the fixed contact 49d on the usually closed side, and the main terminal 42d.

When, subsequently, the knob of the main switching device 22 is rotated to cause the moving contact plate 50d of the switching section 64d to come into contact with the fixed contact 36d on the usually open side, the D.C. motor 78 rotates in the reverse direction to cause the window to be lowered, electricity being supplied through the positive D.C. power source terminal 72, the main terminal 32c of the main switching device 22, the fixed contact 36d on the usually open side, the moving contact plate 50d, the main terminal 33d, the main terminal 42b of the sub-switching device 21, the fixed contact 49b on the usually closed side, the moving contact plate 50b, the main terminal 33b, the D.C. motor 78, the main terminal 33a of the sub-switching device 21, the moving contact plate 50a, the fixed contact 49a on the usually closed side, the main terminal 33c, the moving contact plate 50c, the fixed contact 49c on the usually closed side, the main terminal 42d, and the negative D.C. power source terminal 73. Even when the switching section 64d is thus changed over, the light emitting diode 65 continues to be on since its cathode is connected to the negative D.C. power source terminal 73 through the resistor 75, the diode 76, the auxiliary terminal 47a of the sub-switching device 21, the main terminal 42a, the main terminal 33c of the main switching device 22, the moving contact plate 50c, the fixed contact 49c on the usually closed side, and the main terminal 42d.

The above described embodiment provides the following advantages:

As described above, in each of the moving contact plates 50a to 50d, the first and second movable members 51 and 52 are connected to each other at the respective free end portion 53, 53 in such a manner as to face each other. The first and second movable members are respectively supported by the first and second support sections 60 and 63 at their respective base ends support portions 59 and 62 formed in the respective base end portions 58 and 61. The first movable member 51 includes a curved portion 55 which is so designed as to remain out of contact with the second support portion 63 when its base end portion 58 is pressed downwards, so that, unlike prior art switching devices, the desired snapping action can be achieved without providing in the first movable member 51 a through hole for passing the second support portion 63. Accordingly, the moving contact plates 50a to 50d need not have a large width, so that the switching device can be made compact yet possess a larger current capacity than in the prior art. Furthermore, the respective moving contacts 54 can be pressed against the fixed contacts 36a to 36d as well as 49a to 49d with a sufficient contact pressure.

Moreover, since the first and second movable members 51 and 52 are formed of a single conductor plate in which they are connected to each other at their free end portions 53, 53 through the connecting section 57, they can be manufactured more easily and with fewer parts than in a case where they are separately prepared and then subsequently connected to each other. In addition, the construction of this invention provides an improved conductivity at the free end portions 53, 53 of the first and second movable members 51 and 52, so that generation of heat due to electric current concentration can be mitigated.

While in the above-described embodiment the first and second movable members 51 and 52 are arranged in parallel and connected to each other through the connecting portion 57, this should not be construed as restrictive. The first and second movable members may be connected to each other, for example, in a longitudinal direction.

Further, while the above-described embodiment has been shown as applicable to the switching device of a window regulator, this also should not be construed as restrictive. The present invention can be applied to switching devices in general. Accordingly, it is also applicable to a switching device using a simple make/-break switch section.

What is claimed is:

1. A snap action switching device, comprising:

a first movable member consisting of a plate spring member, one end of which is formed as a free end portion and the other end of which is supported by a first support portion;

a second movable member consisting of a plate spring member, one end of which is formed as a free end portion facing the free end portion of said first movable member, the other end of which is supported by a second support portion situated nearer to the free end portions than said first support portion, and a middle portion of which is formed as a curved portion that is convex in a direction away from said first movable member;

a moving contact portion provided at the free end portions of said first and second movable members;

an operating member which is capable of displacing said first movable member by depressing said first movable member at a position near the supported end thereof in a direction toward said second support portion; and fixed contact portions which are touched or separated from said moving contact portion in accordance with the displacement of said first movable member;

said first movable member having a curved portion near its supported end which is convex in a direction away from the second support portion so that said first movable member will not come into contact with said second support portion when said first movable member is depressed by said operating member.

2. A switching device as claimed in claim 1, wherein the free end portion of said first movable member is integrally formed with the free end portion of said second movable member.

3. A switching device as claimed in claim 1, wherein the free end portion of said first movable member and the free end portion of said second movable member are connected to each other through a connecting portion.

4. A switching device as claimed in claim 1, wherein said first and second movable members are arranged face to face by being bent at a connecting portion.

5. A switching device as claimed in claim 1, wherein said moving contact portion is equipped with a moving contact member which is attached to the free end portions of said first and second movable members.

6. A switching device as claimed in claim 1, further comprising a support member formed of a plate spring in which said first and second support portions are integrally formed.

7. A switching device as claimed in claim 1, wherein a moving contact member is attached to the free end portions of said first and second movable members in such a manner that it is in contact with a first fixed contact member when said operating member is not pressing against said first movable member, and that it is separated from said first fixed contact member and comes into contact with a second fixed contact member upon depression effected by said operating member.

8. A switching device as claimed in claim 1, wherein said first and second movable members are so arranged that, when said first movable member is displaced by a predetermined distance by being depressed by said operating member, they are displaced through a snapping action in the direction of said depression.

9. A switching device as claimed in claim 1, wherein said fixed contact portions include a first fixed contact member which faces said first movable member and which is arranged opposite to a moving contact member, and a second fixed contact member which faces said second movable member and which is arranged opposite to a moving contact member.

10. A switching device as claimed in claim 9, further comprising a base member in which said second fixed contact member and a support member are formed by insert forming.

11. A switching device as claimed in claim 10, further comprising a case member in which said first fixed contact member is formed by insert forming and which is connected to said base member.

12. A switching device, comprising:

a base in which a normally open fixed contact terminal and a moving contact terminal are formed by insert forming, said moving contact terminal including a first and a second support portion, said first support portion being situated farther from said normally open fixed contact terminal than said second support portion;

a case in which a normally closed fixed contact terminal is formed, a fist fixed contact portion mounted on said normally closed fixed contact terminal;

a second fixed contact portion mounted on said normally open fixed contact terminal in such a manner as to face said normally closed fixed contact terminal;

a first movable member made of a plate spring whose one end is formed as a free end section, and whose other end is supported by said first support portion in such a manner that said free end portion is positioned between said first and second fixed-contact portions;

a second movable member made of a plate spring whose one end is formed as a free end portion and whose other end is supported by said second support portion in such a manner that said free end portion of said second movable member is positioned between said second fixed contact portion and said first movable member and whose middle section includes a curved portion convex in a direction away from said first movable member;

a moving contact portion provided at the free ends of said first and second movable members;

an operating member which is movably provided in said case and which can move and depress said first movable member so as to separate said moving contact portion from said first fixed contact portion and bring it into contact with said second fixed contact portion; and a curved section which is formed in said first movable member which is convex in a direction away from said second support portion, and which serves to allow said first movable member not to come into contact with said second support portion when said operating member moves and depresses said first and second movable members.

13. A switching device as claimed in claim 12, wherein the free end portion of said first movable member and the free end portion of said second movable member are integrally formed of one plate.

14. A switching device as claimed in claim 12, wherein the free end portion of said first movable member and the free end portion of said second movable member are connected to each other through a connecting portion.

15. A switching device as claimed in claim 12, wherein said first and second movable members are arranged face to face by being bent at a connecting portion.

16. A switching device as claimed in claim 12, wherein said second support portion is arranged somewhat nearer to the base than said first support portion.

* * * * *